US007741779B2

(12) United States Patent
Takeda et al.

(10) Patent No.: US 7,741,779 B2
(45) Date of Patent: Jun. 22, 2010

(54) METAL VAPOR DISCHARGE LAMP AND ILLUMINATION APPARATUS

(75) Inventors: Kazuo Takeda, Osaka (JP); Hiroji Morimoto, Nara (JP)

(73) Assignee: Panasonic Corporation, Osaka (JP)

( * ) Notice: Subject to any disclaimer, the term of this patent is extended or adjusted under 35 U.S.C. 154(b) by 63 days.

(21) Appl. No.: 12/160,744

(22) PCT Filed: May 28, 2007

(86) PCT No.: PCT/JP2007/060809

§ 371 (c)(1),
(2), (4) Date: Jul. 11, 2008

(87) PCT Pub. No.: WO2007/139058

PCT Pub. Date: Dec. 6, 2007

(65) Prior Publication Data

US 2009/0316410 A1 Dec. 24, 2009

(30) Foreign Application Priority Data

May 31, 2006 (JP) ..... 2006-152724
Mar. 5, 2007 (JP) ..... 2007-054583

(51) Int. Cl.
*H01J 17/16* (2006.01)
*H01J 61/30* (2006.01)

(52) U.S. Cl. ..... 313/634; 313/623; 313/625

(58) Field of Classification Search ..... 313/643, 313/623–625, 635, 493, 318.12, 570, 17, 313/25; 118/50; 445/26, 27
See application file for complete search history.

(56) References Cited

U.S. PATENT DOCUMENTS 4,791,334 A * 12/1988 Keeffe et al. ..... 313/25
5,446,336 A 8/1995 Gleixner et al.
5,453,654 A * 9/1995 Bastian et al. ..... 313/25
2005/0127807 A1 6/2005 Arndt et al.
2007/0159104 A1 7/2007 Kanazawa et al.
2007/0182333 A1 8/2007 Kakisaka et al.

FOREIGN PATENT DOCUMENTS

JP 5-6669 1/1993

(Continued)

OTHER PUBLICATIONS

First Office Action from Chinese Application No. 200780019769.6, issued on Oct. 30, 2009 with a verified partial English translation; 12 pages including translation.

*Primary Examiner*—Nimeshkumar D Patel
*Assistant Examiner*—Thomas A Hollweg

(57) ABSTRACT

A metal vapor discharge lamp and a lighting fixture are downsized without causing breakage of an outer tube because of optimization of a positional relation among the outer tube (34), an inner tube (32), and an arc tube (40). The metal vapor discharge lamp has the arc tube, the inner tube housing the arc tube, and the outer tube housing the inner tube. The positional relation satisfies the relation of $2\times A+B \geqq 1.06$. In a cross section of the lamp (the cross section of the arc tube is unshown for convenience), A (mm) represents the shortest distance between the arc tube and the inner tube along a line in a radial direction of the inner tube, and B (mm) represents a distance between the inner tube and the outer tube on a line segment C that is extension of the line.

2 Claims, 15 Drawing Sheets

FOREIGN PATENT DOCUMENTS

| | | |
|---|---|---|
| JP | 6-124690 | 5/1994 |
| JP | 8-236087 | 9/1996 |
| JP | 11-96973 | 4/1999 |
| JP | 11-265687 | 9/1999 |
| JP | 2000-353420 | 12/2000 |
| JP | 2005-174936 | 6/2005 |
| JP | 2005-183248 | 7/2005 |
| JP | 3115450 | 9/2005 |
| WO | 2006/001166 | 1/2006 |

* cited by examiner

FIG.5

| A (mm) | B (mm) | 2A+B | OUTER TUBE TEMPERATURE (℃) | SAFETY AND RELIABILITY DURING LAMP LIFE |
|---|---|---|---|---|
| 0.00 | 0.33 | 0.33 | 453 | × |
| 0.23 | 0.12 | 0.58 | 447 | × |
| 0.07 | 0.65 | 0.79 | 442 | × |
| 0.32 | 0.28 | 0.92 | 439 | × |
| 0.36 | 0.21 | 0.93 | 438 | × |
| 0.24 | 0.53 | 1.01 | 436 | × |
| 0.53 | 0.10 | 1.16 | 433 | ○ |
| 0.00 | 1.23 | 1.23 | 431 | ○ |
| 0.45 | 0.49 | 1.39 | 427 | ○ |
| 0.79 | 0.14 | 1.72 | 419 | ○ |
| 0.64 | 0.50 | 1.78 | 417 | ○ |
| 1.12 | 0.26 | 2.50 | 399 | ○ |
| 1.19 | 0.22 | 2.60 | 397 | ○ |
| 1.19 | 0.25 | 2.63 | 396 | ○ |
| 1.25 | 0.22 | 2.72 | 394 | ○ |
| 1.28 | 0.23 | 2.79 | 392 | ○ |
| 1.21 | 0.79 | 3.21 | 381 | ○ |
| 1.40 | 0.62 | 3.42 | 376 | ○ |
| 1.61 | 0.20 | 3.42 | 376 | ○ |
| 1.19 | 1.08 | 3.46 | 375 | ○ |
| 0.91 | 1.94 | 3.76 | 368 | ○ |
| 1.94 | 0.15 | 4.03 | 361 | ○ |
| 2.12 | 0.18 | 4.42 | 351 | ○ |

FIG.7

| A (mm) | CONTACT BROWNING |
|---|---|
| 0.00 | × |
| 0.00 | × |
| 0.07 | × |
| 0.23 | × |
| 0.24 | × |
| 0.32 | ○ |
| 0.36 | ○ |
| 0.45 | ○ |
| 0.53 | ○ |
| 0.64 | ○ |
| 0.79 | ○ |
| 0.91 | ○ |
| 1.12 | ○ |
| 1.19 | ○ |
| 1.19 | ○ |
| 1.19 | ○ |
| 1.21 | ○ |
| 1.25 | ○ |
| 1.28 | ○ |
| 1.40 | ○ |
| 1.61 | ○ |
| 1.94 | ○ |
| 2.12 | ○ |

105

117

METAL VAPOR DISCHARGE LAMP AND ILLUMINATION APPARATUS

TECHNICAL FIELD

The present invention relates to a metal vapor discharge lamp, and a lighting fixture having the lamp.

BACKGROUND ART

Metal vapor discharge lamps of high luminance, high efficiency and long life, such as a metal halide lamp (hereinafter, simply referred to as "lamp"), have been widely used in many places for the above features.

A conventional lighting fixture that uses the above lamp as a light source further includes, in addition to the lamp, a reflector that has a concave reflecting surface that reflects light emitted from the lamp in a desired direction. The reflector's light output opening is covered with, for example, a front glass plate (what is called a closed type lighting fixture). Note that the reason for covering the light output opening is to prevent broken pieces of the lamp from scattering outside of the lighting fixture when the lamp (arc tube) is broken for some reasons.

Recently, there has been a demand for a so-called open type lighting fixture whose light output opening is not covered with a front glass. To meet such a demand, a lamp with the following structure is suggested. For example, the lamp is composed of an arc tube, an inner tube and an outer tube, which is so-called a triple-tube structure. The inner tube houses the arc tube, and the outer tube houses the inner tube. If the inner tube is damaged because of the breakage of the arc tube, broken pieces of the inner tube remain within the outer tube. (e.g. Patent Document 1).

Patent Document 1: Japan Unexamined Patent Publication No. H11-96973

DISCLOSURE OF THE INVENTION

Problems the Invention is Attempting to Solve

However, because of the triple-tube structure, the lamp tends to grow in size. To simply downsize the lamp, the arc tube and the inner tube, or the inner tube and the outer tube are brought to be closer to each other. However, the closeness causes the temperature of the outer tube to rise excessively high. When the temperature rises inordinately high, the outer tube has problems, such as deformation and crack, and consequently may be broken.

The present invention is made in view of the above problems. It is an object of the present invention to provide a metal vapor discharge lamp and a lighting fixture that can be downsized while preventing the above problems by optimizing the positions of the outer tube, the inner tube, and the arc tube.

Means for Solving the Problems

To achieve the above object, the present invention provides a metal vapor discharge lamp that includes an arc tube, an inner tube housing the arc tube, and an outer tube housing the inner tube satisfies the following relation:

$$2\times A+B\geqq 1.06$$

where A represents, in millimeters, the shortest distance between the arc tube and the inner tube along a line in a radial direction of the inner tube, and B represents, in millimeters, a distance between the inner tube and the outer tube along the line.

Through experiments, the inventors have figured out that the breakage of the outer tube can hardly occur when the shortest distance A and the distance B between the inner tube and the outer tube satisfy the above relation.

Furthermore, the shortest distance A satisfies the following relation:

$$A\geqq 0.3.$$

Through experiments, the inventors have figured out that when the shortest distance A satisfies the above relation, an area of the arc tube which neighbors the inner tube is prevented from being turned into a brown color.

Furthermore, the arc tube has a pair of electrodes therein that oppose each other substantially in line, and the following relations are satisfied:

$$\alpha\leqq 5, \text{ and}$$

$$\beta\leqq 2.5$$

where $\alpha$ represents, in millimeters, a distance between the arc tube and the inner tube in a cross section in which the distance between the arc tube and the inner tube is shortest, the cross section being taken perpendicularly to an imaginary line that connects the pair of the electrodes, the cross section being present between the pair of the electrodes, and $\beta$ represents, in millimeters, a distance between the inner tube and the outer tube in a cross section in which the distance between the inner tube and the outer tube is shortest, the cross section being taken perpendicularly to the imaginary line that connects the pair of the electrodes, the cross-section being present between the pair of the electrodes.

In another aspect, the present invention provides a lighting fixture including a metal vapor discharge lamp and a reflector that reflects, in a desired direction, light emitted from the metal vapor discharge lamp, and the metal vapor discharge lamp is the metal vapor discharge lamp as described above.

Through experiments, the inventors have figured out that when the shortest distance A of the metal vapor discharge lamp and the distance B between the inner tube and the outer tube satisfy the above relation, the breakage of the outer tube is prevented.

EFFECTS OF THE INVENTION

In a metal vapor discharge lamp in accordance with an embodiment the present invention, a shortest distance A between the arc tube and the inner tube along a line in a radial direction of the arc tube, the distance B between the inner tube and the outer tube along the line, and sizes of the arc tube, the inner tube and the outer tube are determined in the range where the shortest distance A and the distance B satisfy the relational expression of the present invention. Thus, the compact metal vapor discharge lamp that hardly causes the breakage of the outer tube and such can be obtained.

In a lighting fixture in accordance with the present invention, when the shortest distance A and the distance B satisfy the relational expression of the present invention, the outer tube may not be broken or the like. Furthermore, when the sizes of the arc tube, the inner tube and the outer tube are determined in the range where the above relational expression is satisfied, a compact metal vapor discharge lamp that hardly causes the breakage of the outer tube and such can be obtained. Since the lighting fixture includes the lamp, the compact lighting fixture can be obtained.

BRIEF DESCRIPTION OF THE DRAWINGS

FIG. 5 shows the positional relation among the arc tube, the inner tube and the outer tube, and a relation between an outer tube temperature, and safety and reliability during a lamp life;

FIG. 7 shows a relation between the shortest distance A and occurrence of contact browning;

REFERENCE NUMERALS

Figure 1:
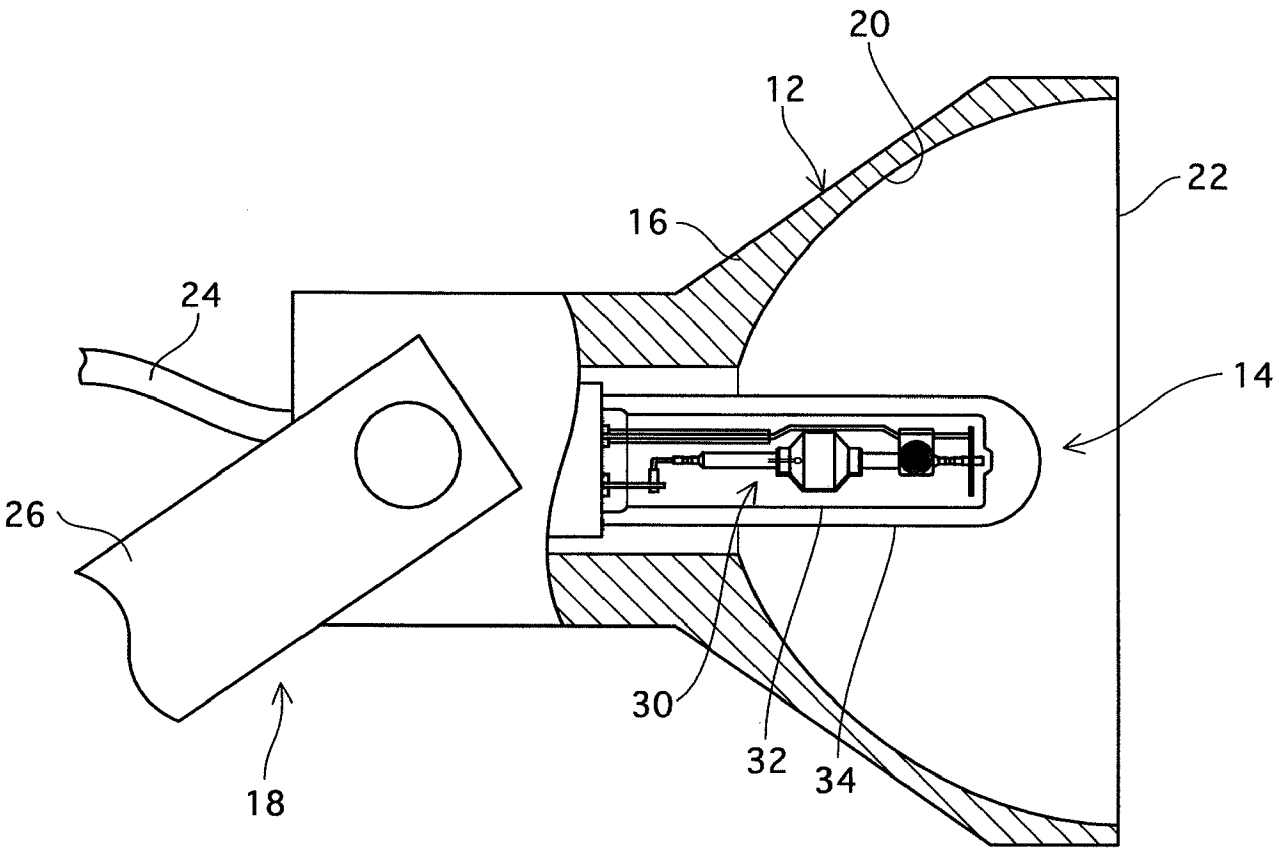
FIG. 1 is an overall view of a lighting fixture in accordance with an embodiment, the view being partially cut out to show the interior of a reflector.

10 lighting fixture
12 lighting apparatus
14 metal halide lamp
16 reflector
30 arc tube
32 inner tube
34 outer tube
36 base
A shortest distance
B distance
α distance
β distance

BEST MODE FOR CARRYING OUT THE INVENTION

The following describes a lighting fixture and a lamp that is employed as a lighting source of the lighting fixture in accordance with an embodiment of the present invention, with reference to the attached figures.

1. LIGHTING FIXTURE

FIG. 1 is an overall view of a lighting fixture 10 in accordance with the embodiment of the present invention. The view is partially cut out so that the inside of the reflector 16 can be seen.)

As shown in FIG. 1, the lighting fixture 10 is composed of a lighting apparatus 12 and a lamp 14 that is mounted on the lighting apparatus 12. Although the lighting apparatus 12 is for spotlighting, note that the lighting fixture of the present invention can be applied to other purposes.

The lighting apparatus 12 includes a reflector 16 that reflects, in a forward direction, light emitted from the lamp 14 placed therein, a socket (unshown) which is mounted inside the reflector 16 and to which the lamp 14 is attached, and an attachment 18 that fixes the reflector 16 to a wall or a ceiling.

As shown in FIG. 1, the reflector 16 has a reflecting surface 20 in a concave shape. This reflecting surface 20 is made of, for example, alumina glass. Note that the reflector 16 is so-called a (forwardly) open type reflector whose opening 22 (light output opening) is not covered with a glass plate or the like. Note that a lighting fixture that uses an open type reflector is also called an open type lighting fixture.

The socket is electrically connected to a base of the lamp 14 and supplies the lamp 14 with electricity. Note that a ballast (unshown) to light the lamp 14 is fixed on, for example, the ceiling (or in the roof space), such as being embedded in the ceiling, and supplies the electricity to the lamp 14 via a power supplier 24 that is described later.

The attachment 18 is, for example, in a shape of the letter "U," and includes a pair of arms 26 (,26) that are arranged in parallel to each other and a connection part (unshown) that connects the pair of the arms 26 (,26). The reflector 16 is rotatably fixed by being sandwiched by the pair of the arms 26 (,26). The connection part is attached to, for example, the wall or the ceiling. Note that a direction of the light radiated from the lighting fixture 10 can be adjusted by rotating the attachment 18 that is rotatably fixed to the reflector 16.

2. LAMP

Figure 2:
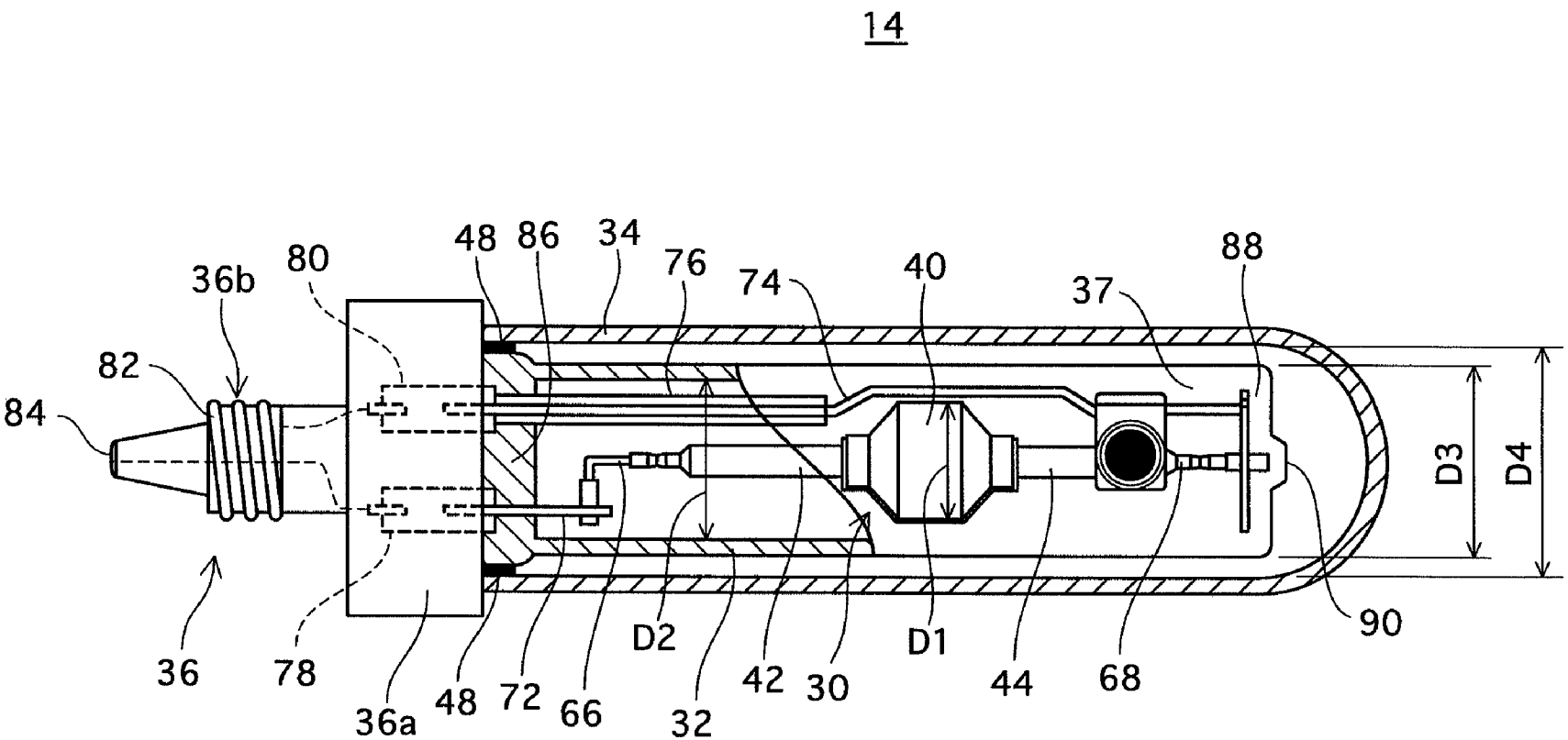
FIG. 2 is an elevational view of a lamp in accordance with the embodiment.

FIG. 2 is an elevational view of the lamp 14 in accordance with the embodiment of the present invention.

The lamp 14 has a triple-tube structure, with an arc tube 30 having a pair of electrodes and a discharge space therein, an inner tube 32 that is an airtight envelope housing the arc tube 30, and an outer tube 34 that is a protective envelope housing the inner tube 32. The lamp 14 further includes a base 36 that receives the electricity from the socket of the lighting apparatus 12.

Note that in a case where the arc tube is broken for some reason, and consequently the broken pieces damage the inner tube 32, since the lamp 14 includes the outer tube 34, the breakage of the arc tube 30 usually does not damage the outer tube 34.

Figure 3:
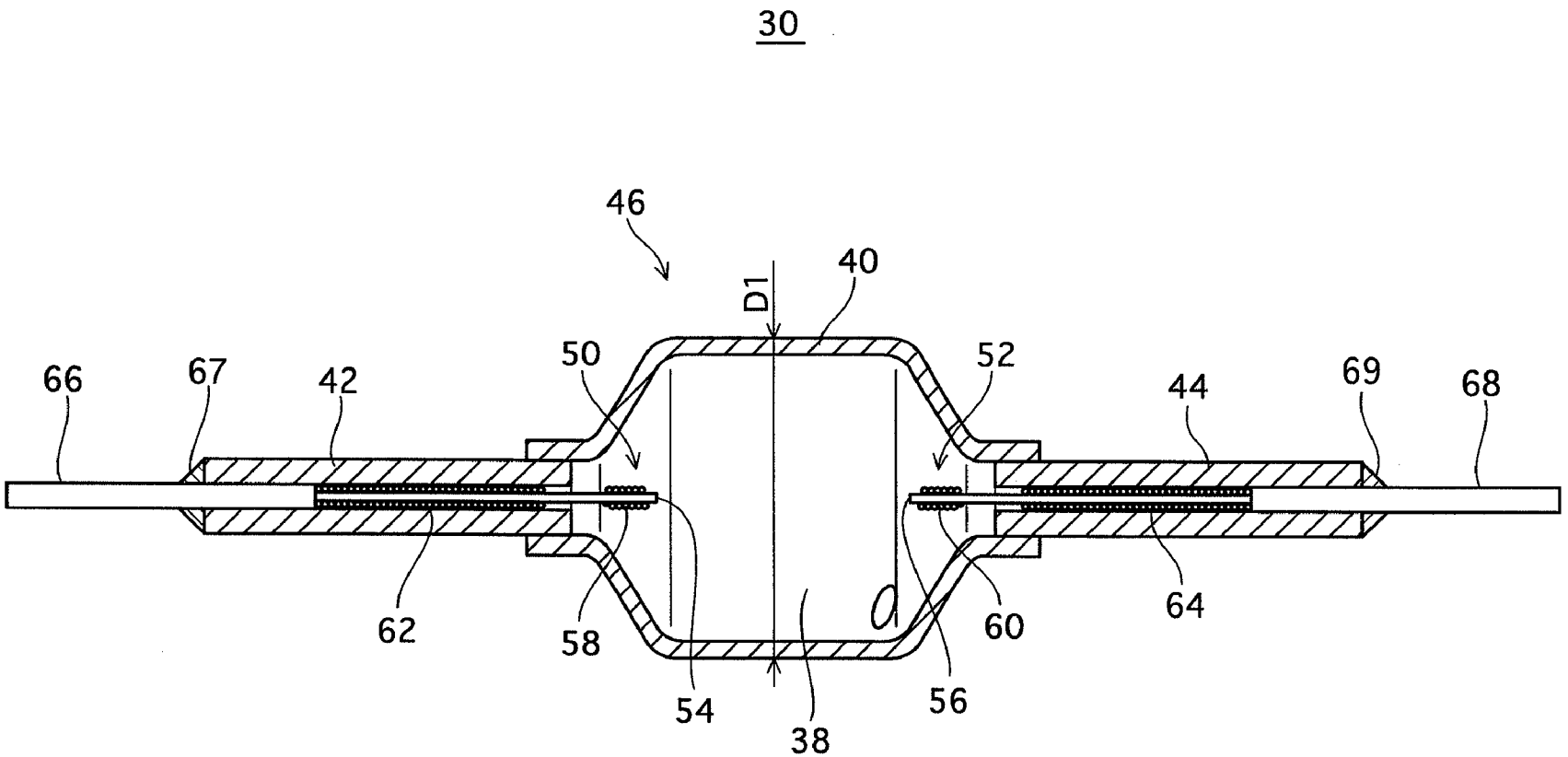
FIG. 3 is an elevational view, partly in section, of an arc tube.

FIG. 3 is an elevational view partly in section, of the arc tube 30.

The arc tube 30 has an envelope 46 that includes a main tube part 40 having an airtight discharge space 38 therein and thin tube parts 42 and 44 each extending outwardly in the axial direction of the main tube part 40. The main tube part 40 and the thin tube parts 42 and 44 are made of transparent ceramic materials, such as polycrystalline alumina ceramics.

Note that the main tube part 40 and the thin tube parts 42 and 44 may be made of other ceramics, quartz glass or the like.

The main tube part 40 is provided with a pair of electrodes 50 and 52 provided within the discharge space 38. The electrodes 50 and 52 approximately oppose each other on the central axis in the longitudinal direction of the lamp 14 (hereinafter, simply referred to as "lamp axis"), or on a parallel axis to the lamp axis. In addition, within the discharge space 38, given amounts of metal halide that is a luminous material, a rare gas that aids start of the lighting, mercury that is a buffer gas are enclosed. As the metal halide, for example, mixed iodide made of sodium iodide, dysprosium iodide or cerium iodide is used. Note that the metal halide for the use depends on a luminous color of the lamp 14.

As shown in FIG. 3, the electrodes 50 and 52 include electrode rods 54 and 56, and electrode coils 58 and 60 respectively. The electrode coils 58 and 60 are disposed at top ends (toward the discharge space 38) of the electrode rods 54 and 56, respectively. Note that in clearances between the electrode rods 54 and 56 and the thin tube parts 42 and 44, the electrode rods 54 and 56 around which molybdenum coils 62 and 64 are wound are inserted so as to prevent invasion of the luminous material.

Note that as described above, ideally (in a design), the electrodes 50 and 52 are approximately opposed to each other on the lamp axis, which is to say, the central axes of the electrode rods 54 and 56 are arranged approximately on the lamp axis. However, actually, due to the accuracy of the process, the central axes may not be on the lamp axis.

Power feeders 66 and 68 whose ends are connected to the electrodes 50 and 52, respectively, are inserted to the thin tube parts 42 and 44 respectively. The power feeders 66 and 68 are respectively sealed with sealing members 67 and 69 that are made of frit poured into the thin tube part 42 and 44 from the opposite end to the main tube part 40. Note that parts of the sealing members 67 and 69 shown in FIGS. 2 and 3 are the frit running out from the ends of the thin tube parts 42 and 44.

The description of the lamp 14 is made again.

As shown in FIG. 2, one end of the power feeder 66 opposite to the electrode 50 is electrically connected to a power supplier 72. Similarly, one end of the power feeder 68 opposite to the electrode 52 is electrically connected to a power supplier 74. The power suppliers 72 and 74 are electrically connected to a shell 82 and an eyelet 84, respectively, of the base 36 via metal foils 78 and 80, and such.

A part of the power supplier 74 toward the base 36 that faces the power supplier 72 and the power feeder 66 connected thereto is covered with a sleeve 76 made of, for example, quartz glass.

As shown in FIG. 2, the above-mentioned arc tube 30 and the like are housed in the inner tube 32 that is in a tubular shape such as a cylinder. The inner tube 32 is made of, for example, quartz glass. One end of the inner tube 14 that is in the vicinity of the metal foils 78 and 80 is pinched flatly with use of so-called pinch sealing, and accordingly the inner tube 32 is sealed airtight around the metal foils 78 and 80.

Thus, the inner tube 32 is an airtight envelope whose one end is sealed. The pinched and sealed end of the inner tube 32 is called a pinch seal part 86.

A protrusion part 90 present at another end of the inner tube 32 is a tip-off part that is a remnant of an exhaust pipe having been used for evacuating atmosphere from the inner tube 32. The inner tube 32 is evacuated in order to prevent oxidation of metal members such as the power feeders 66 and 68, the power suppliers 72 and 74 and the like that are exposed to high temperatures during the operation of the lamp.

The inner tube 32 is covered with the outer tube 34 in a bottomed tubular shape (which is a tube having one open end and one closed end) as shown in FIGS. 2 and 3. The outer tube 34 is made of hard glass, for example, and serves as a protective tube. More specifically, when the arc tube 30 is broken and the inner tube 32 is damaged, the outer tube 34 serves to prevent pieces of broken glass and such from scattering.

As with the inner tube 32, the outer tube 34 is in a tubular shape such as a cylinder in order to make the lamp compact. The interior of the outer tube 34 communicates with the exterior of the outer tube 32, which is to say, the outer tube 34 is exposed to the atmosphere. Note that, in this embodiment, the inner tube housing the arc tube, the outer tube and the base are bonded with an adhesive (e.g. cement)

In addition to the function as the protective tube, the outer tube 34 has the following function. The outer tube 34 absorbs, from light that is emitted from the arc tube 30 and passes through the inner tube, ultraviolet that is radiated from the lamp and affects human body and the like.

3. POSITIONAL RELATION AMONG ARC TUBE, INNER TUBE, AND OUTER TUBE

Figure 4:
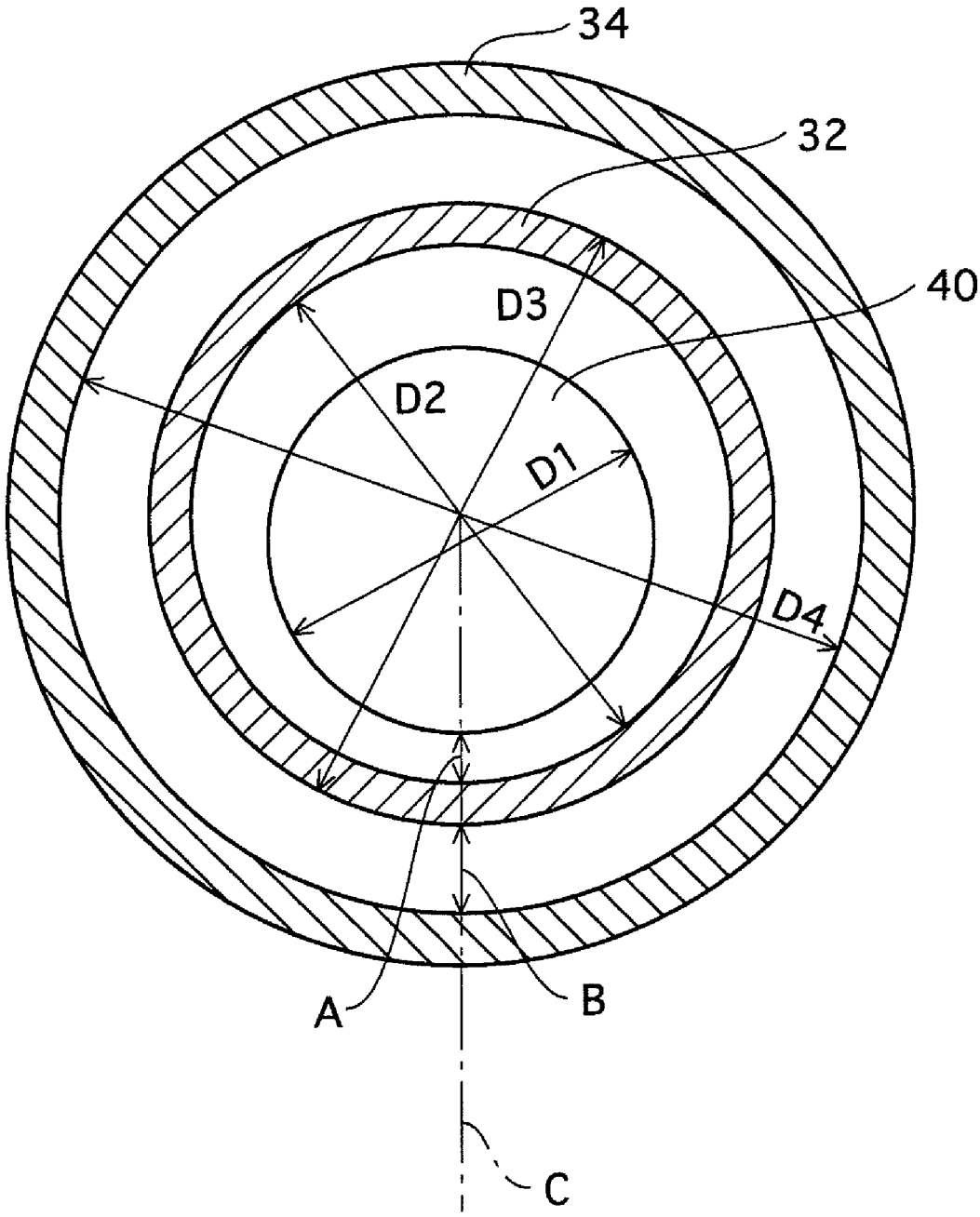
FIG. 4 is a schematic view showing a positional relation among the arc tube, an inner tube and an outer tube.

FIG. 4 is a schematic view of a section orthogonal to the lamp axis, showing a positional relation among the arc tube 30, the inner tube 32, and the outer tube 34.

Through various studies, the inventors have obtained the optimum positional relation among the arc tube 30, the inner tube 32, and the outer tube 34 that does not cause the breakage of the outer tube 34.

A distance between the inner tube 32 and the arc tube 30 that is the shortest distance along a line in a radial direction of the arc tube 30 is expressed as A (hereinafter, simply referred to as "shortest distance A"). A distance between the inner tube 32 and the outer tube 34 on an imaginary extension C along the line where the shortest distance is present is expressed as B (hereinafter, simply referred to as "distance B." That is to say, it is turned out that the breakage of the outer tube 34 can be prevented when the following expression is satisfied, $$2\times A+B\geqq 1.06 \qquad \text{(Expression 1).}$$

FIG. 5 shows the positional relation among the arc tube 30, the inner tube 32 and the outer tube 34, and a relation between a temperature of the outer tube, and safety and reliability during a lamp life.

This experiment was carried out as follows. The lamp 14 was lit when the lamp axis was on an approximately horizontal status (hereinafter, simply referred to as "horizontal lighting"), and the outer tube temperature was measured with a thermocouple. Note that when the outer tube temperatures were measured, extrapolation calculated from thermal changes after turning off the lamp was employed. The extrapolation was used to accurately measure the temperatures of the outer tube 34 by eliminating the influence of the thermal radiation that is caused by the arc tube 30 and is exerted upon the thermocouple.

The safety and the reliability during the lamp life were measured by checking strain accumulation generated in the outer tube 34 with use of a strain meter. The "○" in FIG. 5 shows that the strain accumulation of the outer tube 34 is in an unproblematic range, whereas the "×" shows that the strain accumulation falls within a problematic range.

Power consumption of the lamp 14 used in the experiment is 70 (W). The arc tube 30 includes the main body part 40 whose maximum outside diameter D1 is 9.7 (mm). The wall thickness of the inner tube 32 is 1.25 (mm), the inside diameter D2 of the inner tube 32 is 13 (mm), and the outside diameter D3 of the inner tube 32 is 15.5 (mm). The wall thickness of the outer tube 34 is 1.3 (mm), the inside diameter D4 of the outer tube 34 is 17.9 (mm), and the outside diameter of the outer tube 34 is 20.5 (mm). The bulb wall loading is set to 25.5 ($W/cm^2$)

The shortest distance A and the distance B are set to given values as follows. The tube axes of the arc tube 30, the inner tube 32, and the outer tube 34 are displaced, and consequently, the arc tube 30 and the inner tube 32 are partially brought closer to each other (this distance corresponds to the shortest distance A). In an imaginary extension of a line connecting the arc tube 30 and the inner tube 32, a distance (this corresponds to the distance B) between the inner tube 32 and the outer tube 34 is adjusted.

As shown in FIG. 5, the following is obtained by the lighting experiment carried out with use of various samples of the lamp 14 each having different values with regard to the shortest distance A and the distance B.

In short, if the relation of the above Expression 1 is satisfied, the evaluation of the safety and reliability during the lamp life shows "○." More specifically, when the shortest distance A is 0.53 (mm) and the distance B is 0.10 (mm), "2×A+B" equals to 1.16. As this value equals to or above "1.06" of Expression 1, Expression 1 is satisfied. In such a case, the outer tube temperature reaches to 433 (° C.), and the evaluation of the safety and reliability during the lamp life is "○."

However, when the shortest distance A is 0.24 (mm) and the distance B is 0.53 (mm), "2×A+B" equals to 1.01. This value is smaller than "1.06" of Expression 1, which does not satisfy Expression 1. In such a case, the outer tube temperature reaches to 436 (° C.), and the evaluation of the safety and reliability during the lamp life is ×."

4. EMBODIMENT

A sample of the lamp 14 according to the present invention that was down sized by the above experiment and the like requires power consumption of 70 (W); The entire length of the lamp 14 is approximately 100 (mm)-120 (mm) (the length is slightly variable by the base 36 and such used for the experiment) As for the arc tube 30, the maximum outside diameter D1 of the main tube part 40 is 9.7 (mm).

The wall thickness of the inner tube 32 is 1.25 (mm). The inside diameter D2 of the inner tube 32 is 13 (mm), and the outside diameter D3 of the inner tube 32 is 15.5 (mm). The wall thickness of the outer tube 34 is 1.3 (mm), the inside diameter D4 of the outer tube 34 is 17.9 (mm), and the outside diameter of the outer tube 34 is 20.5 (mm).

Note that in this embodiment, the shortest distance A is 1.65 (mm), and the distance B is 1.2 (mm).

The size of the lamp 14, namely the outside diameter of the outer tube 34, is 20.5 (mm), whereas that of a conventional lamp is 30 (mm). Thus, approximately 32% of the lamp size is reduced. Note that in this embodiment, inconvenience, such as breakage of the outer tube 34 and the browning of the inner tube 32 at the end of the lamp life, is not observed.

5. CONSIDERATION

The inventors studied the cause of the breakage of the outer tube 34.

The study was carried out as follows. Plural types of lamp samples each having a different shortest distance A between the arc tube 30 and the inner tube 32 and a different distance B between the inner tube 32 and the outer tube 34 were produced without changing the sizes and specifications of the arc tube 30, the inner tube 32, and the outer tube 34. With use of the lamp samples, horizontal lighting (lamp life) experiment was carried out. In this experiment, the temperature of the outer tube 34 (at a portion showing the highest temperature) of each sample of the lamp 14 was measured.

Note that the temperature was measured within a compact fixture (a fixture going thorough the thermally severest condition) that meets the requirement of the marketplace.

As a result of this measurement, in addition to the breakage of the lamp 34, a new problem is found that the color of the inner tube 32 is changed to a brown color according to a position of the inner tube 32 with regard to the arc tube 30.

Furthermore, the lighting experiment with use of a plurality of the samples of the lamp 14 each having different shortest distance A and distance B reveals that the breakage of the outer tube 34 depends on the temperature and that the browning occurred within the inner tube depends on the distance (namely, the shortest distance A) between the inner tube 32 and the arc tube 30.

In short, it is turned out that the outer tube 34 is broken due to the following reason. The temperature of the outer tube 34 rises high, and consequently, small deformations occur inside a glass material composing the outer tube 34. The temperature further rises or falls from the high temperature, which increases the deformations. In due course of time, the outer tube 34 is cracked, and finally broken. Note that it is also turned out that deformation of the outer tube 34 due to heat is caused when the temperature of the outer tube rises excessively high.

On the other hand, it is turned out that the phenomenon of the browning within the inner tube is caused as follows. During the lamp is lit, alumina of alumina ceramic that is a material of the main tube part 40 of the arc tube 30 evaporates, and the alumina vapor is deposited on the inner surface of the inner tube 32.

An amount of the alumina of the main tube part 40 deposited on the inner tube 32 depends on the distance between the main tube part 40 of the arc tube 30 and the inner tube 32. That is to say, when the distance between the arc tube 30 and the inner tube 32 is long, the deposition amount decreases. On the contrary, when the distance between the arc tube 30 and the inner tube 32 is short, the deposition amount increases. Note that since this phenomenon of browning the inner tube 32 caused by this deposition occurs when the inner tube 32 comes in contact with (or is extremely close to) the arc tube 30, hereinafter, this phenomenon is referred to as "contact browning."

The inventors have confirmed the following fact from the experiment and the like. When a design temperature of the outer tube is 435 (° C.) or below, the breakage of the outer tube 34 does not occur.

Hence, the inventors measured the temperatures of the outer tube 34, keeping the distance B between the inner tube 32 and the outer tube 34 constant while changing the shortest distance A between the arc tube 30 and the inner tube 32.

(1) Result of Measuring Outer Tube Temperature

Figure 6:
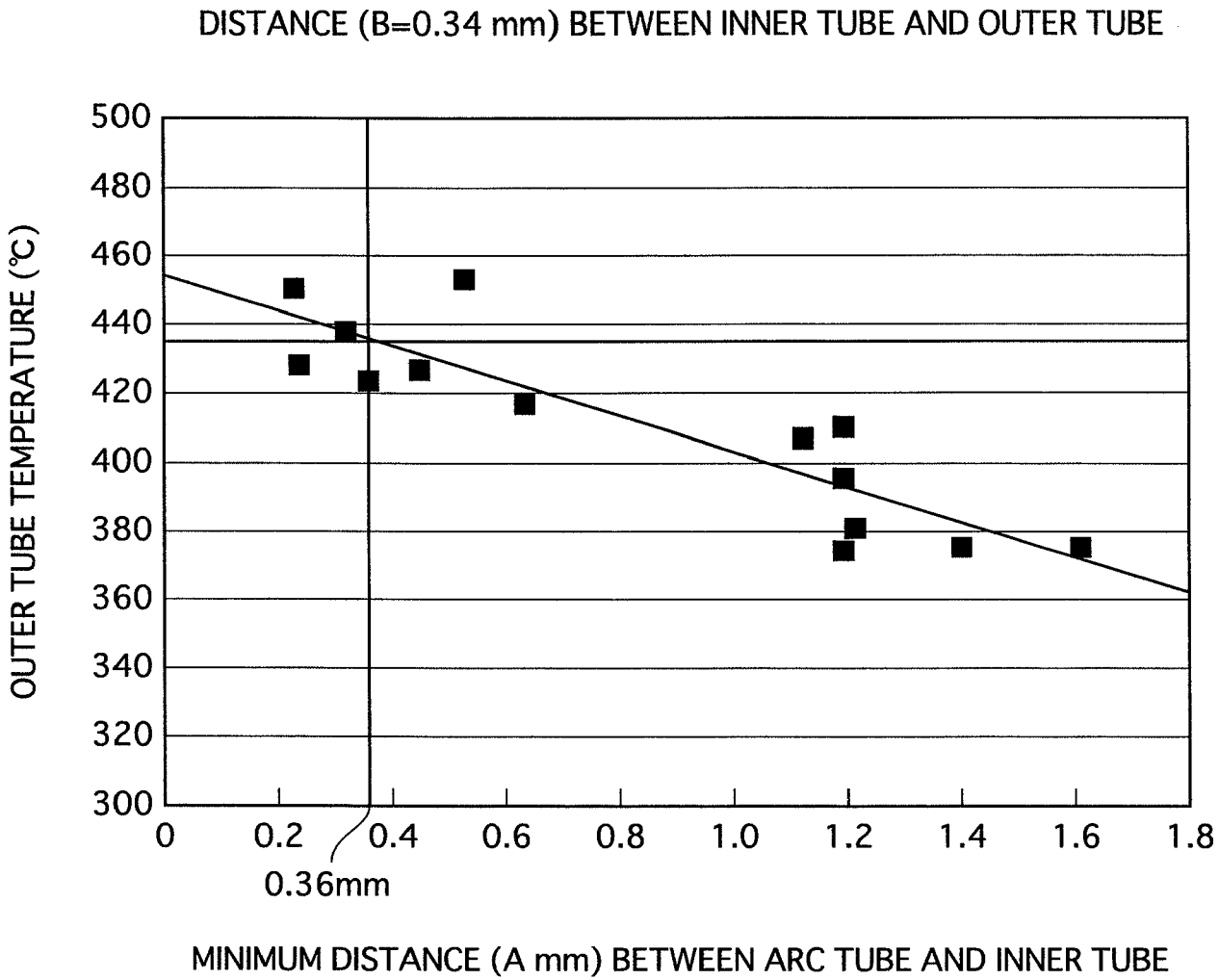
FIG. 6 shows a relation between a shortest distance A and the outer tube temperature when a distance B is set to 0.34 (mm)

FIG. 6 shows a relation between the shortest distance A and the outer tube temperature when the distance B is set to 0.34 (mm)

In this lighting experiment, the temperatures of the outer tube 34 were measured when the lamp was in the horizontal lighting position. The temperatures of the outer tube 34 were measured in the same way as the above outer tube temperatures. As shown in FIG. 6, on the condition that the distance B between the inner tube 32 and the outer tube 34 is set to 0.34 (mm), the temperature of the outer tube 34 rise to 435 (° C.) or higher when the shortest distance A between the arc tube 30 and the inner tube 32 is 0.36 (mm) or below.

Carrying out similar experiments by setting the distance B as not only 0.34 (mm) but also other values, the inventors have obtained the relation shown in Expression 1.

(2) Occurrence of Contact Browning

FIG. 7 shows a relation between the shortest distance A and occurrence of contact browning.

FIG. 7 shows, according to the length of the shortest distance A, results obtained by visually checking whether the occurrence of browning of lamps on which the above experiments (whose investigation are concluded in FIG. 5) are carried out. When the occurrence of browning is visually observed, "×" is put. When the occurrence of browning is not visually observed, "○" is put.

As FIG. 7 shows, when the above Expression 2 is satisfied, the occurrence of browning can be suppressed. More specifically, the occurrence of browning is not observed when the shortest distance A is, for example, 0.32 (mm). On the other hand, when the shortest distance is 0.24 (mm), the occurrence of browning is observed. Accordingly, it can be construed that a boundary that causes browning is when the shortest distance A is 0.3 (mm).

In short, when the shortest distance A satisfies the following relation, $$A \geqq 0.3 \text{ (mm)} \qquad \text{(Expression 2)}$$

the occurrence of browning (contact browning) inside the inner tube can be prevented.

In FIG. 7, some values of the shortest distance A are identical (e.g. 0.00 (mm)). Note that, as shown in FIG. 5, such a value indicates a lamp having the same shortest distance A and different distances B.

As described above, on the condition that the shortest distance between the inner tube and the arc tube along a line in a radial direction is expressed as A, and that a distance between the inner tube and the outer tube 34 along the line is expressed as B, the following relations are to be satisfied to prevent the breakage of the outer tube and the occurrence of browning inside the inner tube, $$2 \times A + B \geqq 1.06, \text{ and } A \geqq 0.3$$

However, considering the lamp size, the following range is preferable.

In short, the following holds. A cross section of the arc tube is taken perpendicularly to an imaginary line that connects the pair of the electrodes, and is taken between the pair of the electrodes. The cross section is taken when a distance between the arc tube and the inner tube is shortest (hereinafter, referred to as "Cross section 2"). A distance between the arc tube and the inner tube in the cross section is expressed as α (mm). The distance α is desirably 5 (mm) or below, more desirably 4 (mm) or below, and even more desirably 3 (mm) or below. Note that the distance α can be represented by the following expression.

$$\alpha = (\text{inside diameter of inner tube in Cross Section 2} - \text{outside diameter of arc tube in Cross Section 2})/2$$

A cross section of the arc tube is taken perpendicularly to an imaginary line that connects the pair of the electrodes, and is taken between the pair of the electrodes. The cross section is taken when a distance between the inner tube and the outer tube is shortest (hereinafter, referred to as "Cross Section 1"). The distance between the inner tube and the outer tube in the cross section is expressed as β (mm). The distance β is desirably 2.5 (mm) or below, more desirably 2.0 (mm) or below, and even more desirably 1.5 (mm) or below. Note that the distance β can be represented by the following expression.

$$\beta = (\text{inside diameter of outer tube in Cross Section 1} - \text{outside diameter of inner tube in Cross Section 1})/2$$

The distances α and β that fall within the above range reduce the lamp size. For example, the diameter of a hole in the reflector on which the lamp is mounted can be reduced, a light output ratio can be improved, and the reflector can be downsized. Thus, the overall size of the lighting fixture can be reduced. Note that, herein, the light output ratio is a ratio indicating how efficiently luminous flux of the lamp can be emitted as the luminous flux of the lighting fixture.

<Modification>

Thus, the present invention is described based on the above embodiment. However, the present invention is never limited to the specific example indicated in the above embodiment, and the following modifications can be made, for example.

1. Outer Tube (1) Shape

In the above embodiment, the outer tube is in a bottomed tubular shape having one open end (toward the base) and one closed end in a hemispherical shape. However, the outer tube in accordance with the present invention is not limited to the shape described in the embodiment. The following describes a lamp with an outer tube in a different shape from that of the embodiment.

(1-1) Modification 1

Figure 8:
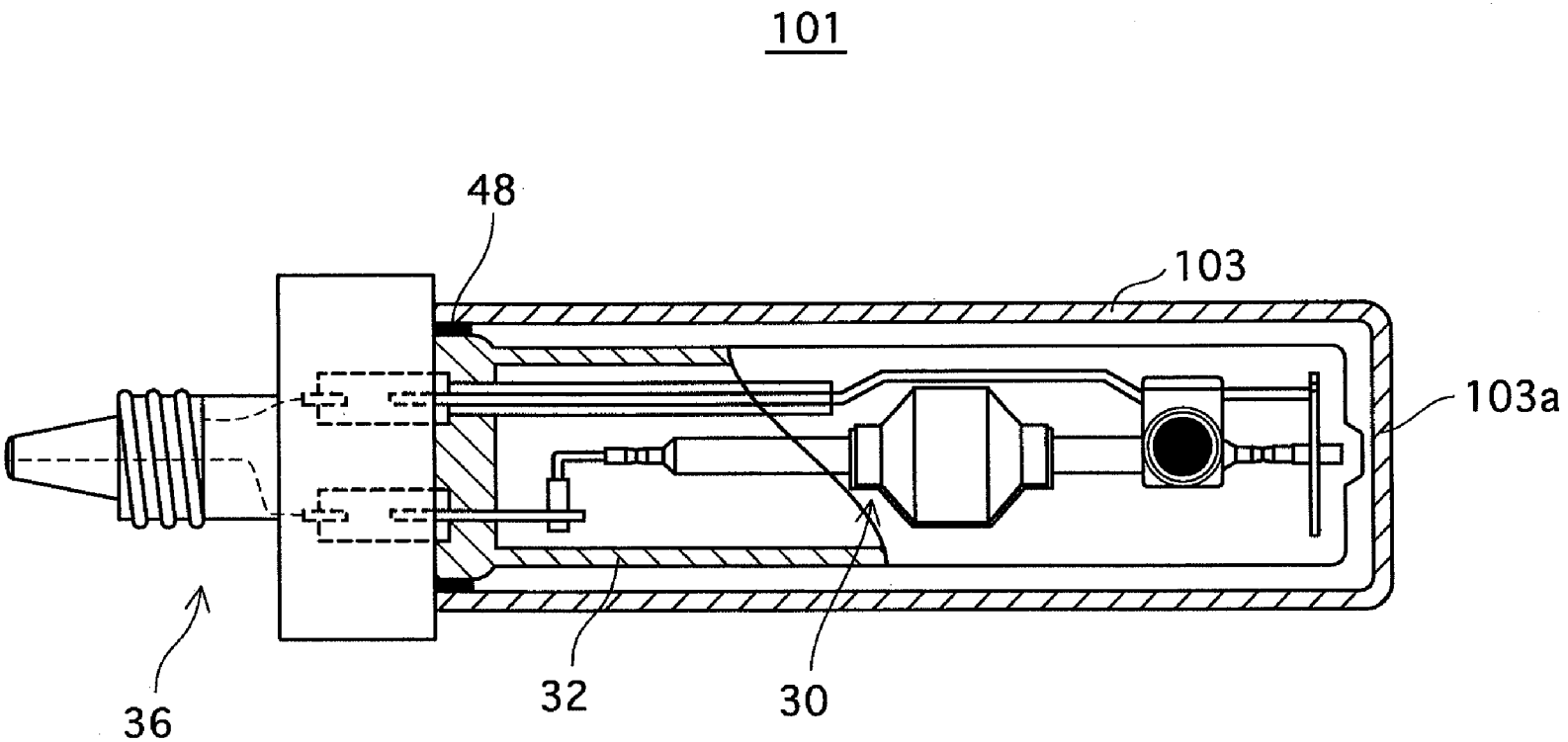
FIG. 8 is an elevational view, partially cutout, of a lamp in accordance with a modification 1.

FIG. 8 is a partially cutout elevational view of a lamp 101 in accordance with a modification 1.

As shown in FIG. 8, the entire shape of an outer tube 103 in accordance with the modification 1 is a bottomed tubular shape having one open end (toward a base) and one closed end. Seen from a direction orthogonal to a direction to which the outer tube 103 extends (referred to as the axial direction), the outer tube 103 appears to be rectangular. That it to say, another end 103*a* (namely, the end located opposite to the base 36) of the outer tube 103 is in a flat shape.

(1-2) Modification 2

Figure 9:
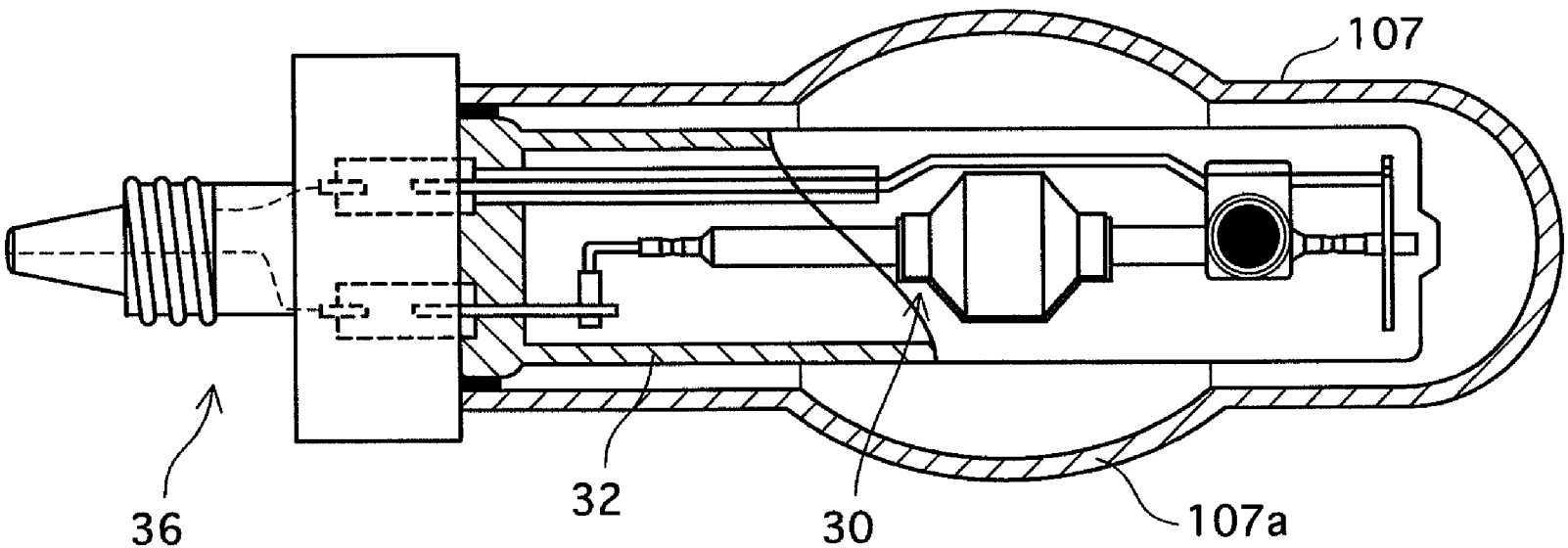
FIG. 9 is an elevational view, partially cutout, of a lamp in accordance with a modification 2.

FIG. 9 is a partially cutout elevational view of a lamp 105 in accordance with a modification 2.

The outer tubes 34 and 103 in accordance with the embodiment and the modification 1 are each in a bottomed tubular shape having one open end (toward the base) and one closed end, and its tubular shape is straight. However, as shown in FIG. 9, the entire shape of an outer tube 107 in accordance with the modification 2 is in a bottomed tubular shape having one open end (toward the base) and one closed end, and the outer tube 107 has a swollen part 107*a* at the center thereof in the axial direction.

In a vertical section of the outer tube 107, the swollen part 107*a* forms an arc. However, the swollen part 107*a* may be in other shapes, for example, in a multangular shape such as a triangle, or in a trapezoidal shape and the like. Note that the entire shape of the outer tube is in a three-dimensional shape formed by rotating the vertical section of the outer tube 107 about the axis direction.

(1-3) Modification 3

Figure 10:
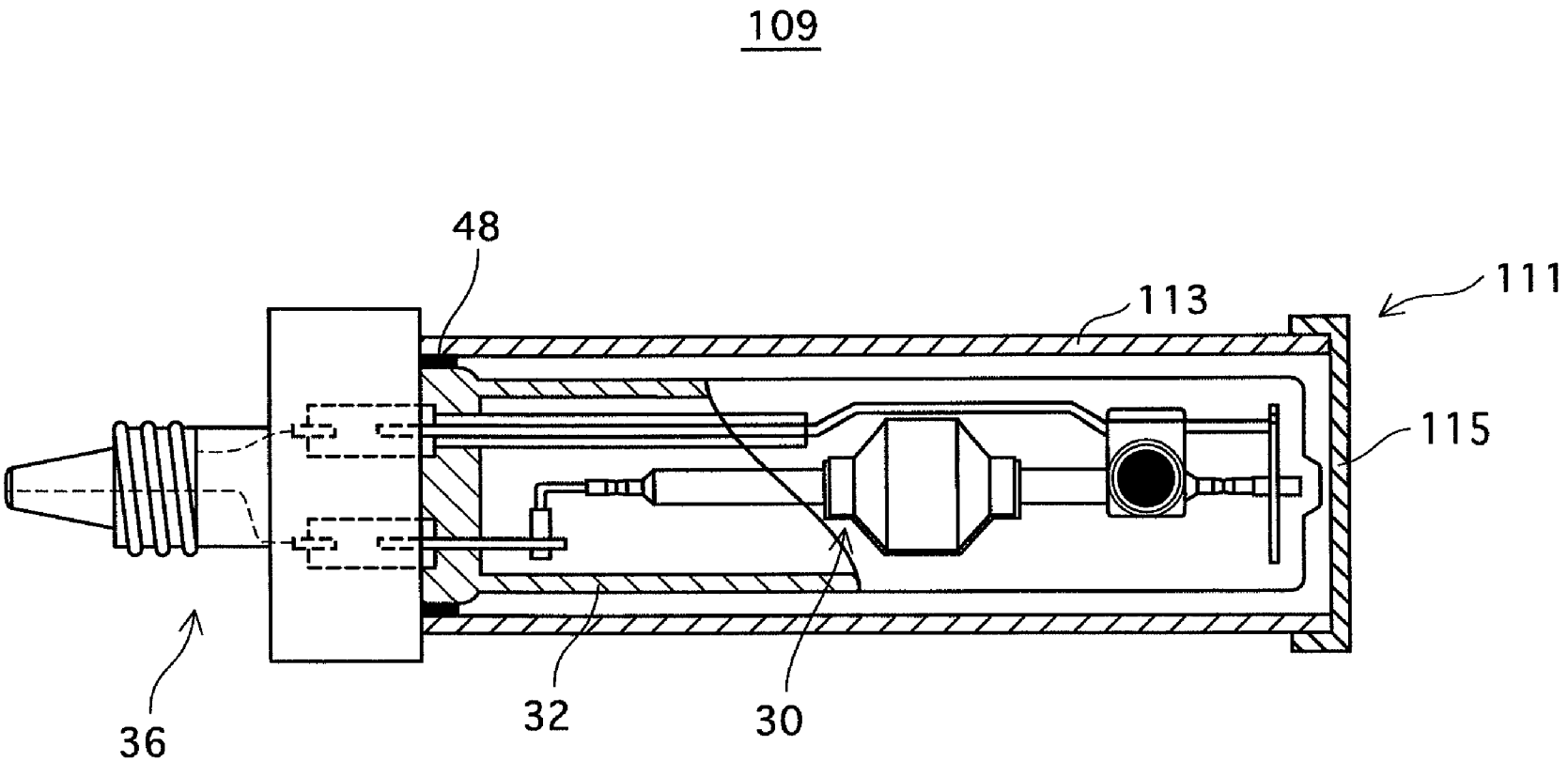
FIG. 10 is an elevational view, partially cutout, of a lamp in accordance with a modification 3.

FIG. 10 is a partially cutout elevational view of a lamp 109 in accordance with a modification 3.

The outer tubes 34, 103 and 107 in accordance with the embodiment, the modifications 1 and 2 are each composed of a glass tube whose one end (toward the base) is open and other end is closed. On the other hand, as shown in FIG. 10, an outer tube 111 in accordance with the modification 3 is composed of a tubular glass tube whose both ends are open.

That is to say, the outer tube 111 in accordance with the modification 3 has a tube part 113 in a tubular shape whose both ends are open and a closing part 115 that closes another end (end opposite to the base 36) of the tube part 113. Herein, the closing part 115 may have any structure as long as the broken pieces of the inner tube 32 and the arc tube 30 are prevented from flying all over when the inner tube 32 is broken due to the breakage of the arc tube 30. For example, a metal cap (e.g. made of stainless) as shown in FIG. 10 may be used.

(1-4) Others

The outer tubes in accordance with the embodiment and modifications 1 and 2 are straight-shaped, with their tube diameters roughly invariant. However, each of the outer tubes may be in a shape whose tube diameter changes gradually or stepwise from the end near the base to another end, such as a tapered shape.

(2) Inner and Outer Surfaces

The embodiment and modifications do not especially describe the inner or outer surfaces of the outer tubes 34, 103, 107 and 111. One of the inner and outer surfaces of the outer tube of the present invention may be frosted. At least one of the inner and outer surfaces may be entirely or partially frosted. In addition, the inner surface and the outer surface may be partially frosted. Note that frosting of opposite end of the outer tube (including the end) to the base serves glare prevention.

(3) Glare Prevention

The embodiment and modifications do not make a special description on the glare prevention. However, the outer tube in accordance with the present invention may have a function of preventing the glare. This function may be achieved by a glare prevention member. More specifically, the glare prevention member may be a metal cap that partially covers the outer tube to shield light generated from a lamp in such a manner that when the lamp is mounted on the reflector, the light is not reflected by the reflector but is directly emitted outside of the reflector.

In this case, the shape and the structure of the outer tube covered with the metal cap are not especially limited. The metal cap is applicable to, for example, the outer tube 34 of the embodiment, as well as the outer tubes 103 and 107 of the modifications 1 and 2.

Note that the metal cap of the modification 3 has the function of the glare prevention.

2. Envelope

An envelope 46 that composes the arc tube 30 of the embodiment is formed as follows. After the main tube part 40 and the thin tube parts 42 and 44 are formed separately, the thin tube parts 42 and 44 are jointed to the main tube part 40 with use of shrink fitting. However, an envelope of the present invention is not limited to that of the embodiment.

Instead of separately forming the main tube part 40 and the thin tube parts 42 and 44, the envelope may have a unitary structure, for example, that the main tube part 40 and the two thin tube parts 42 and 44 are integrally formed.

In addition, the envelope may be composed of two molded parts each of which is integrally formed by joining a half of the main tube to the thin tube part. More specifically, a fitting part of the half of the main tube and its equivalent are joined with alumina paste and sintered together to be integrally formed.

The envelope may be composed of a tubular member (concretely a cylindrical part), a ring member and a thin tube part member. The ring member is integrally formed with the tubular member, being joined at each end of the tubular member with use of shrink fitting. The thin tube member is integrally formed with one end thereof placed into a penetrating hole at the center of the ring member with use of shrink fitting. In this case, the envelope is of so-called a cylindrical type.

3. Base (1) Connection Type

As shown in FIG. 2, in the embodiment and modifications 1-3, the base 36 of so-called Edison type of a screwed type that has a shell 82 in a screwed shape and an eyelet 84 is. However, a base of another type may be used.

Figure 11:
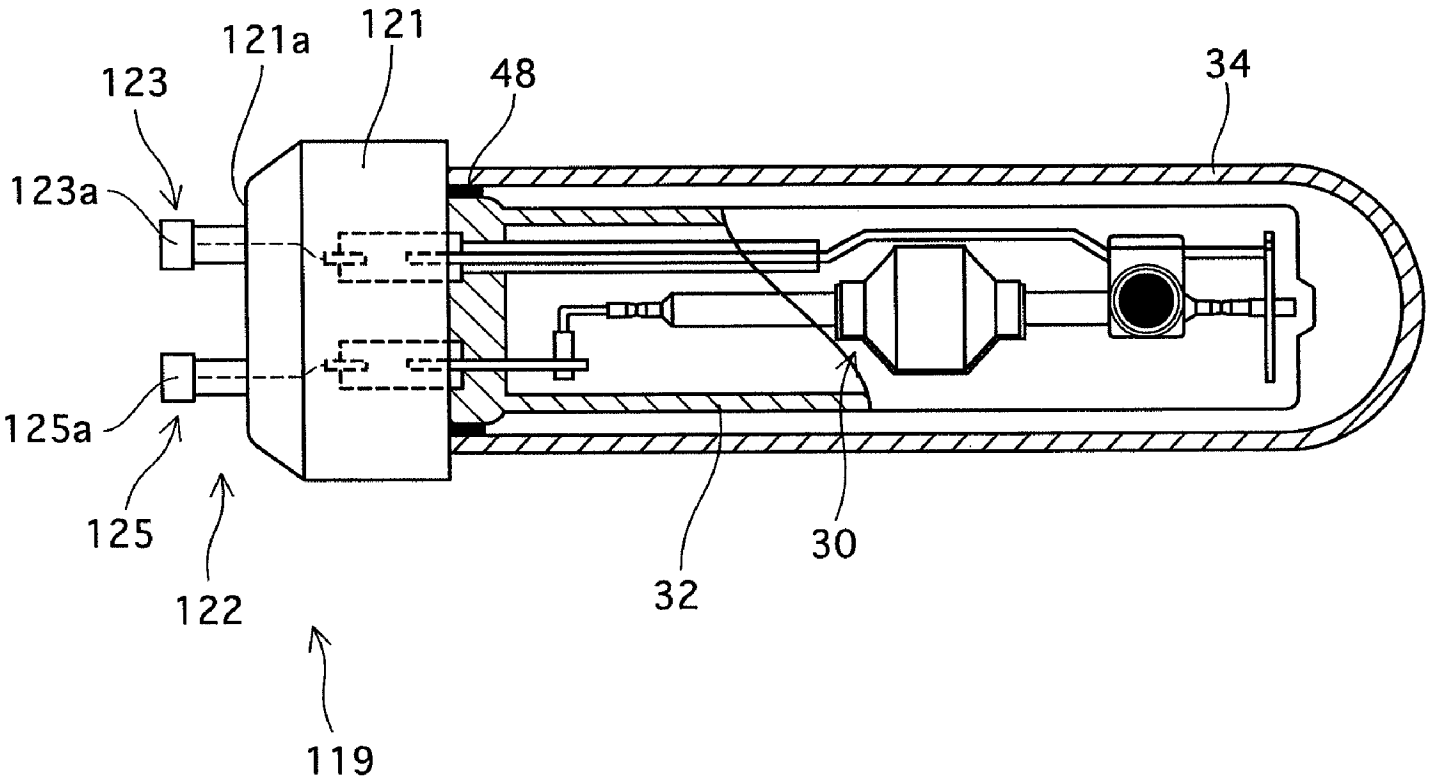
FIG. 11 is an elevational view, partially cutout, of a lamp in accordance with a modification 4.

FIG. 11 is a partially cutout elevational view of a lamp 117 in accordance with a modification 4.

As shown in FIG. 11, a base 119 in accordance with the modification 4 includes a main body part 121 and a terminal part 122 disposed on a bottom 121*a* of the main body part 121.

The terminal part 122 includes a pair of pin terminals 123 and 125. Large diameter parts 123*a* and 125*a* may be disposed at the ends of the pin terminals 123 and 125. This base 119 is of so-called Swan type.

As a matter of course, the base 119 may be of so-called G type or PG type whose pin terminals (123, 125) do not have the large diameter parts 123*a* and 125*a*.

(2) Shape

The embodiment does not especially describe the base 36. As shown in FIG. 2, the bases 36 and 119 are provided with the main body parts 36*a* and 121, and the terminal parts 36*b* and 122 disposed on the main body parts 36*a* and 121. The terminal parts 36*b* and 122 may be, for example, of Edison type, Swan type, G type, PG type and the like.

The outer shapes of the main body parts 36*a* and 121 in the embodiment and modifications 1-4 are cylindrical. However, the outer shape of the main body part does not have to be cylindrical, and other shapes are also applicable.

Figure 12:
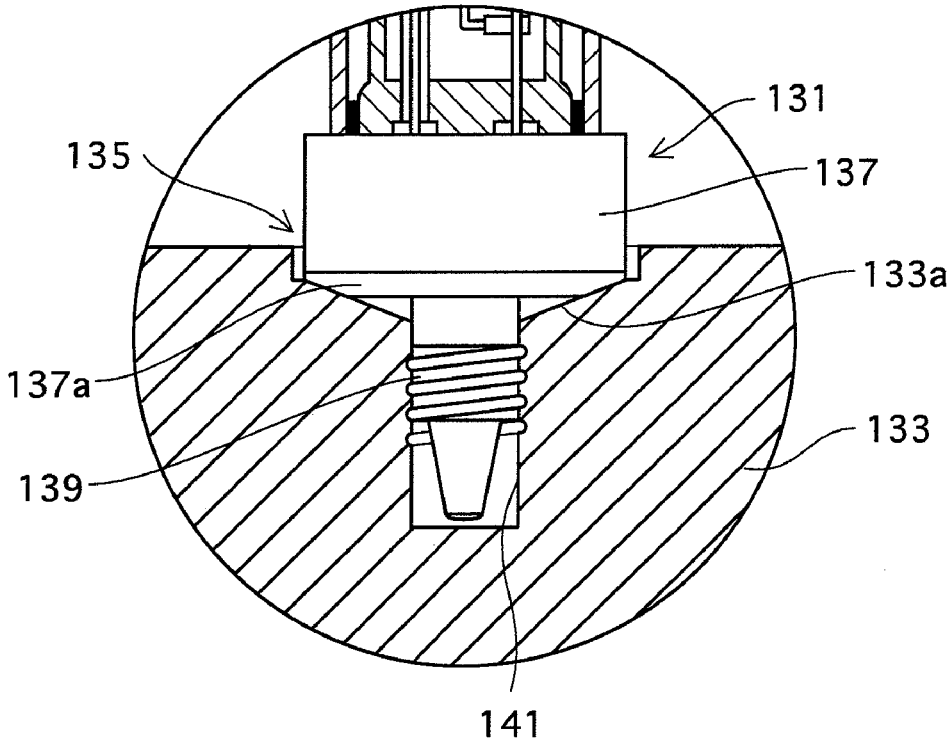
FIG. 12 is an enlarged view of a base when a lamp in accordance with a modification 5 is attached to a socket.

FIG. 12 is an enlarged view of a base when a lamp 131 in accordance with a modification 5 is attached to a socket 133.

A base 135 in accordance with the modification 5 has a main body part 137 and a terminal part 139. The terminal part 139 is that of Edison type, and is screwed into a connecting hole 141 of the socket 133. However, the shape of the base 135 of the modification 5 is different from that of the base 36 of the embodiment.

As shown in FIG. 12, an end of the main body part 137 that is tapered toward the terminal part 139 is a tapered part 137*a*. Note that the socket 133 also has a tapered part 133*a* that is a counterpart of the tapered part 137*a* and in contact with the tapered part 137*a*.

As described above, the tapered part 137*a* of the main body part 137 of the base 135 pairs up with the tapered part 133*a* of the socket 133, which prevents a different type of a lamp from being mounted to the socket 133 (so-called improper use).

In other words, on the condition that the different type of the lamp is to be mounted on the socket 133, if an attempt is made to insert a terminal part (139) of a base to a connecting hole (141) of the socket (133), the shape of a bottom (137*a*) of the main body part (137) does not match (is different from) that of the connecting hole (141). As a result, an eyelet of the terminal part (139) does not reach the position that is electrically connected with the socket (133).

Figure 13:
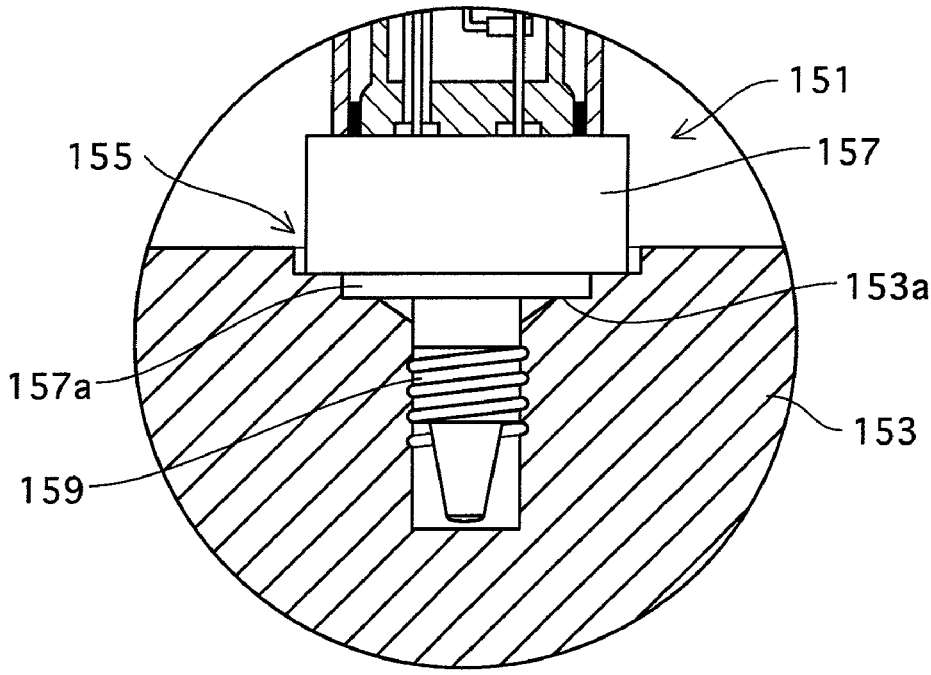
FIG. 13 is an enlarged view of a base when a lamp in accordance with a modification 6 is attached to a socket.

FIG. 13 is an enlarged view of a base when a lamp 151 in accordance with a modification 6 is attached to a socket 153.

A base 155 in accordance with the modification 6 has a main body part 157 and a terminal part 159, similarly to the base 135 of the modification 5.

The base 135 of the modification 5 has the tapered part 137*a* in the main body part 137. However, the base 155 of the modification 6 has a stepped part 157*a* on a main body part 157. Needless to say, a socket 153 has a stepped part 153*a* that fits with the stepped part 157*a* of the main body part 157 of the modification 6. The stepper part 153*a* pairs up with the stepped part 157*a*.

The base 155 of the modification 6 having the stepped part 157*a* can prevent the improper use of the lamp as described in the modification 5.

Note that in the modifications 5 and 6, the terminal parts 139 and 159 are of Edison type. However, the terminal parts may also be of Swan type, G type, PG type and such. Such bases can also prevent the improper use of the lamp.

Note that the sockets 133 and 153 shown in FIGS. 12 and 13 are illustrated to show the relation of attachment and connection to the bases 135 and 155, and that their structures and the shapes are different from those of a real socket.

4. Connection Between Inner Tube and Base

In the embodiment, the adhesive 48 is used to bond the inner tube 32 and the base 36. However, other methods may be used for connection. The following describes, as modifications, other methods to connect the inner tube housing the arc tube and the base.

(1) Modification 7

Figure 14:
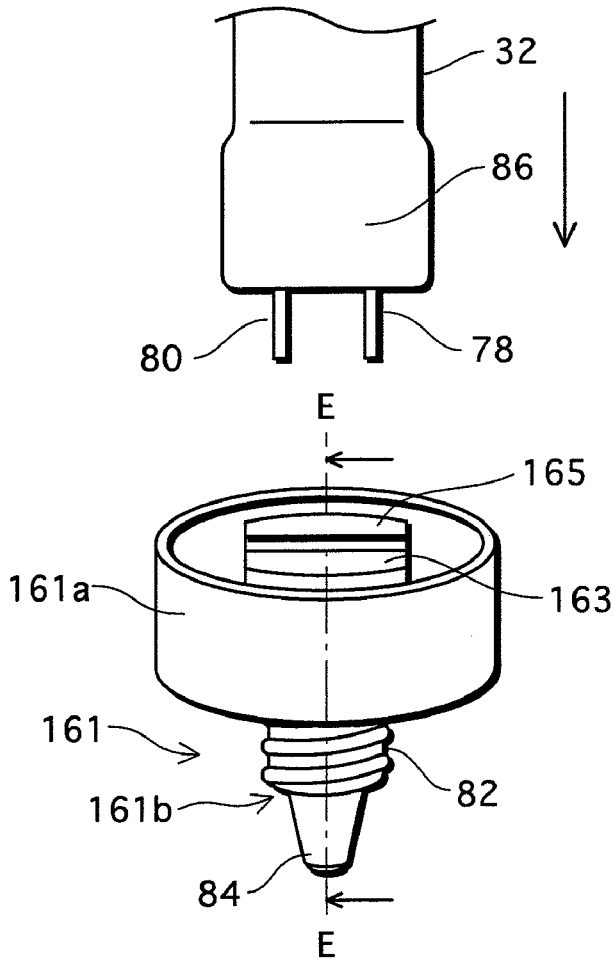
FIG. 14 is a view showing connection between an inner tube and a base in accordance with a modification 7.
Figure 15:
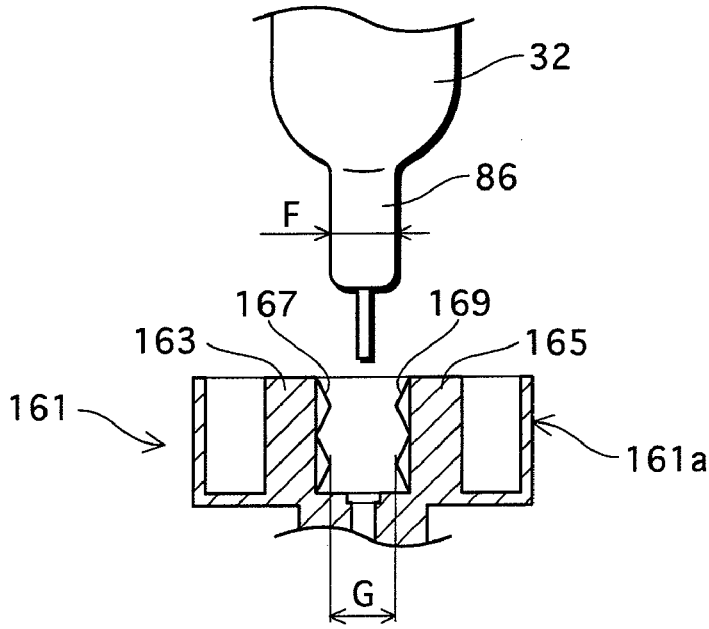
FIG. 15 is a sectional view taken along a line E-E seen in an arrow direction shown in FIG. 14.

FIG. 14 is a view showing bonding between the inner tube 32 and a base 161. FIG. 15 is a sectional view of the base taken along the line E-E shown in FIG. 14, viewed in the arrow direction.

The inner tube 32 of a modification 7 has a similar structure with the inner tube of the embodiment. Therefore, the same reference numeral 32 is used for the inner tube of the modification 7. The inner tube 32 has a sealing part at an end thereof. The sealing part is sealed to hermitically house the arc tube 30 within the inner tube 32. Here, as with the embodiment, the sealing part is a pinch seal part 86 that is pinched flatly with use of pinch-sealing.

As shown in FIGS. 14 and 15, the base 161 has a pair of supporting parts 163 and 165 inside the main body part 161*a*. An interval between the pair of the supporting parts 163 and 165 is larger than a thickness F (a size measured in a direction of pinch sealing) of the pinch seal part 86 of the inner tube 32. Elastic members 167 and 169 are provided between the pair of the supporting parts 163 and 165. On the condition that the elastic members 167 and 169 are provided between the pair of the supporting parts 163 and 165, an interval G (see FIG. 15) formed between the supporting parts 163 and 165 (the elastic members 167 and 169) is smaller than the thickness F of the pinch seal part 86.

The inner tube 32 and the base 161 are connected by the pinch seal part 86 of the inner tube 32 being inserted between the pair of the supporting parts 163 and 165 of the base 161. That is to say, when the pinch seal part 86 is inserted between the supporting parts 163 and 165, the elastic members 167 and 169 are deformed. Then, memory of this deformation supports the pinch seal part 86. Accordingly, the inner tube 32 is fixed to the base 161 without using an adhesive.

More specifically, as shown in FIG. 15, the elastic members 167 and 169 are made of metal, and the shapes of their vertical sections are dogleg (a zigzag having a "W" shape rotated for 90 degrees). With this structure, a thickness (size measured in a direction orthogonal to the direction of the insertion of the pinch seal part) of each of the elastic members 167 and 169 is changed according to the insertion of the pinch seal part 86 that deforms the elastic members 167 and 169.

Note that as long as elastic members disposed between the supporting members 163 and 165 are deformed by insertion of the end (pinch seal part) of the inner tube, and this deformation secures the end (pinch seal part) of the inner tube, any shape, quantity, material and the like are applicable.

For example, although the elastic members 165 and 167 of the modification 7 are each in a zigzag shape, other shapes are also applicable. As long as the inner tube (pinched-seal part) can be fixed, there may be only one elastic member disposed between the supporting parts. The elastic members may be made of a metal material, such as stainless or other metal materials. Note that the deformation caused by the insertion of the end of the inner tube depends on the material, the thickness, and such of the elastic members.

(2) Modification 8

Figure 16:
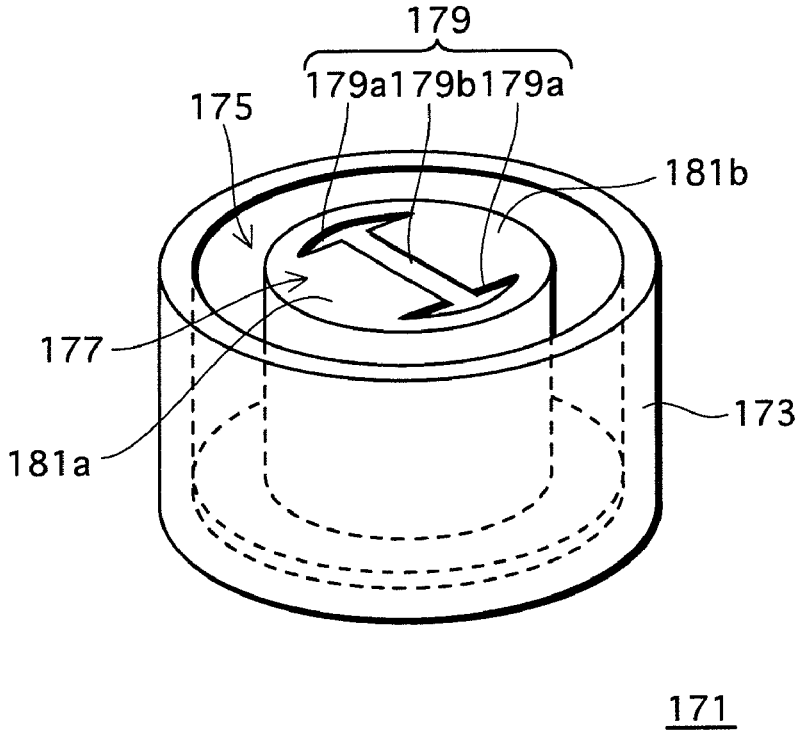
FIG. 16 is a perspective view of a main body part of a base in accordance with a modification 8.
Figure 17:
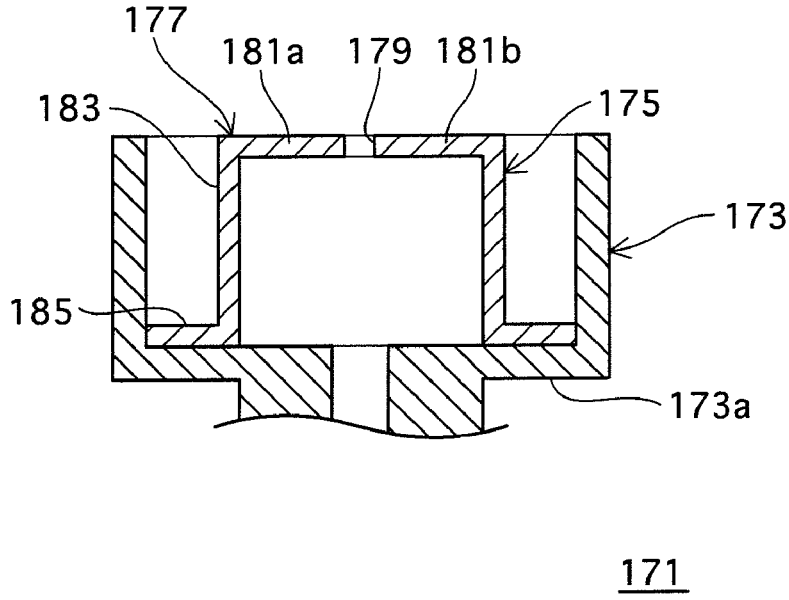
FIG. 17 is a vertical sectional view of the main body part of the base in accordance with the modification 8.

FIG. 16 is a perspective view of a main body part 173 of a base 171 in accordance with a modification 8. FIG. 17 is a vertical sectional view of the main body part 173.

The base 171 is provided with a supporting member 175 that supports an inner tube at a base part 173*a* (corresponding to a bottom) of the main body part 173. The supporting member 175 is in a bottomed tubular shape, having an end wall 177 on which a through hole 179 is formed. Parts of the end wall 177 are tongue pieces 181*a* and 181*b* that are deformed according to the insertion of the end of the inner tube. The through hole 179 into which the inner tube is inserted allows the tongue pieces 181*a* and 181*b* to be deformed.

As shown in FIG. 16, the through hole 179 is composed of a pair of parallel holes 179*a* and 179*a* that are parallel to each other in a predetermined direction, and a connection hole 179*b* that connects approximately the center of the pair of the parallel holes 179*a* and 179*a*. The entire shape of the through hole 179 is approximately the letter "H." Both parts that sandwich the connection hole 179*b* are the tongue pieces 181*a* and 181*b*.

The supporting member 175 is obtained by drawing a metal plate of a given thickness. The metal plate is as thick as the following degree. When the inner tube is inserted into the through hole 179, the tongue pieces 181*a* and 181*b* are bent in the direction of the insertion.

Note that the supporting member 175 of the modification 8 has a flange part 185 at an opposite end to the end wall 177 of a tube part 183. The flange part 185 extends outward in a direction perpendicularly to the central axis of the tube part 183. This flange part 185 is fixed to the base part 173*a* of the main body part 173 of the base 171.

The tongue pieces 181*a* and 181*b* of the supporting member 175 are deformed according to the insertion of the end (pinch seal part) of the inner tube. As long as the deformation serves to fix the inner tube, any shape, material, and the like are applicable.

More specifically, although the through hole that determines the shape of the tongue piece is in a shape of the alphabetical letter "H", the through hole may be a Chinese character "王" that looks as if two converted letters "H" were stacked. In such a case, the total number of the tongue pieces is four. Also, there may be two tongue pieces that oppose each other, and the shape of each tongue piece may be the converted letter "T" or the letter "U" meshing each other.

Furthermore, the shape and the like of the supporting member 175 are not especially limited. The base may have the supporting member 175 and the main body part 173 of the modification 8 that are integrally formed.

5. Connection between Outer Tube and Base

In the embodiment, the main body part 36*a* of the base 36 is in a bottomed tubular shape. In a state where the end of the outer tube 34 is inserted into the main body part 36*a*, the outer circumference of the end of the outer tube and the inner circumference of the main body part 36*a* are bonded with the adhesive 48 (e.g. cement). However, other shapes of the outer tube and the base are also applicable. The following modifications describe different shapes of the outer tube and the base that are connected together from those of the embodiment and modifications 1-8.

(1) Modification 9

Figure 18:
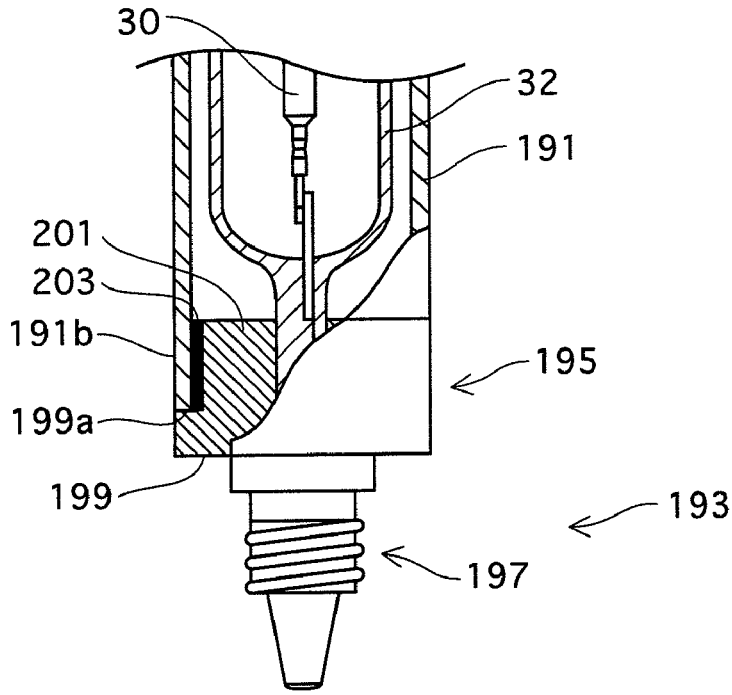
FIG. 18 is a view showing connection between an outer tube and a base in accordance with a modification 9.

FIG. 18 is a view showing bonding between an outer tube 191 and a base 193 in accordance with a modification 9.

The base 193 in accordance with the modification 9 has a main body part 195 and a terminal part 197.

The main body part 195 has a discoidal base part 199 and a supporting part 201 that is formed on approximately the center of the base part 199. When this main body part 195 is viewed in the axial direction of the outer tube 191, a distance between a fringe of the outer circumference of the base part 199 and the tube axis is larger than a distance between a fringe of the outer circumference of the supporting part 201 and the tube axis. A flat part 199*a* is formed between the two fringes.

The outer tube 191 and the base 193 are bonded as follows. In a state where an open end 191*a* of the outer tube 191 is in contact with the flat part 199*a* of the base part 199, an inner surface of an open end part 191*b* of the outer tube 191 and an outer surface of the supporting part 201 are bonded together with an adhesive 203.

(2) Modification 10

In the embodiment and modification 9, the adhesive 48 is used to bond the outer tube 34 and the base 36. However, other methods by which an adhesive is not employed are also applicable. The following describes, as a modification 10, another method for connecting the outer tube and the base.

Figure 19:
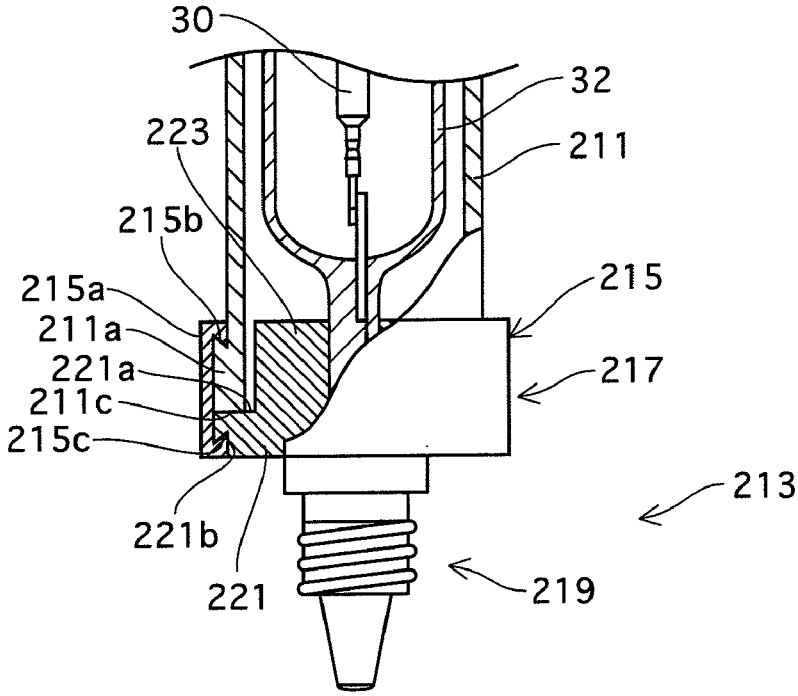
FIG. 19 is a view showing connection between an outer tube and a base in accordance with a modification 10.

FIG. 19 is a view showing bonding between an outer tube 211 and a base 213 in accordance with the modification 10.

A lamp in accordance with the modification 10 has a structure to connect an outer tube 211 and a base 213 with use of a connecting member 215.

At an end of the outer tube 211 toward the base 213, a projection part 221*a* that projects outward is formed. This projection part 211a may comprise a plurality of the projection parts 211*a* placed in the whole circumference or placed at intervals in a circumferential direction of the end part of the outer tube 211.

The base 213 has a main body part 217 that supports an inner tube 32 and a terminal part 219 that is electrically connected with a socket.

The main body part 217 has a discoidal base part 221 and a supporting part 223 that is formed on approximately the center of the base part 221. When this main body part 217 is viewed in the axial direction of the outer tube 211, a distance between a fringe of the outer circumference of the base part 221 and the tube axis is larger than a distance between a fringe of the outer circumference of the supporting part 223 and the tube axis. A flat part 221*a* is formed between the two fringes.

As shown in FIG. 19, at an end of the base part 221 of the main body part 217 opposite to the arc tube 30, a depressed part 221*b* that is caved inwardly is formed. Corresponding to the projection part 211*a*, the depressed part 221*b* may comprise a plurality of the depressed part 221*b* placed along the whole circumference of the end of the main body part 217, or placed at intervals in a circumferential direction of the end of the main body part 217.

The connection member 215 has a tube part 215*a* that externally fits the projection part 211*a* of the outer tube 211 and the base part 221 of the base 213. At an end of the tube part 215*a*, an outer tube locking part 215*b* that is locked to an end of the projection part 211*a* of the outer tube 211 is provided. On another end of the tube part 215*a*, a base locking part 215*c* that is locked to the depressed part 221*b* of the base part 221 of the base 213 is provided.

Corresponding to the projection part 211*a* of the outer tube 211 and the depressed part 221*b* of the base 213, a plurality of locking parts 215*b* and 215*c* of the connection member 215 may be provided along the whole circumference of each end or at intervals in the circumferential direction.

The outer tube 211 and the base 213 are connected as follows. In a state where an open end of the outer tube 211 is in contact with the flat part 221*a* of the base part 221, the open end of the outer tube 211 and the flat part 221*a* of the base 221 are covered with the connection member 215. Then, the base locking part 215*b* of the connection member 215 is locked to the projection part 211*a* of the outer tube 211, and the base locking part 215*c* of the connection member 215 is locked to the depressed part 221*b* of the base 213.

Note that in the modification 10, the outer tube and the base are connected (locked) by the connection member (locking member). However, the outer tube may be connected (locked) to an integral part made of the base and the connection member. Also, the outer tube may be directly locked to the base.

6. Last

In the embodiment, the power consumption is 70 (W). However, the present invention is not limited to this. The power consumption falling within a range between 20 W-150 W is applicable to the present invention. In the embodiment, the inner tube is single-sealed, with one end thereof being sealed. However, both of the ends of the inner tube may be sealed.

Any combination of the disclosure of the embodiment and modifications 1-10 are applicable. For example, a lamp may be composed of the outer tube of the modification 2 and a base that is a combination of technical features of the modifications 6 and 8.

INDUSTRIAL APPLICABILITY

The present invention including an arc tube, an inner tube, and an outer tube is applicable to a metal vapor discharge lamp and a lighting device that are to be compact.

The invention claimed is:

1. A metal vapor discharge lamp including an arc tube, an inner tube housing the arc tube, and an outer tube housing the inner tube, the arc tube having a pair of electrodes therein that oppose each other substantially in line, wherein the following relational expression is satisfied:

$$2\times A+B\geqq 1.06;$$

$$A\geqq 0.3,$$

where

A represents, in millimeters, a shortest distance between the arc tube and the inner tube along a line in a radial direction of the inner tube, and B represents, in millimeters, a distance between the inner tube and the outer tube along the line, and the following relational expressions are further satisfied:

$$\alpha\leqq 5;\text{ and}$$

$$\beta\leqq 2.5$$

where

α represents, in millimeters, a distance between the arc tube and the inner tube in a cross section 2 in which the distance between the arc tube and the inner tube is shortest, the cross section 2 being taken perpendicularly to an imaginary line that connects the pair of the electrodes, the cross section 2 being present between the pair of the electrodes, α being defined by the following relational expression:

α=(Inside Diameter of Inner Tube in Cross Section 2−Outside Diameter of Arc Tube in Cross Section 2) 2, and β represents, in millimeters, a distance between the inner tube and the outer tube in a cross section 1 in which the distance between the inner tube in a cross section 1 in which the distance between the inner tube and the outer tube and the outer tube is shortest, the cross section 1 being taken perpendicularly to the imaginary line that connects the pair of the electrodes, the cross section 1 being present between the pair of the electrodes, β being defined by the following relational expression:

β=(Inside Diameter of Outer Tube in Cross Section 1−Outside Diameter of Inner Tube in Cross Section 1)/2.

2. A lighting fixture including a metal vapor discharge lamp and a reflector that reflects, in a desired direction, light emitted from the metal vapor discharge lamp, wherein the metal vapor discharge lamp is a metal vapor discharge lamp as defined in claim 1.

* * * * *